US009260835B2

(12) United States Patent
Kang

(10) Patent No.: US 9,260,835 B2
(45) Date of Patent: Feb. 16, 2016

(54) SYSTEM FOR DRIVING A BOOM OF A HYBRID EXCAVATOR AND A CONTROL METHOD THEREOF

(75) Inventor: Byung Il Kang, Gyeonggi-do (KR)

(73) Assignee: Doosan Infracore Co., Ltd., Incheon (KR)

( * ) Notice: Subject to any disclaimer, the term of this patent is extended or adjusted under 35 U.S.C. 154(b) by 766 days.

(21) Appl. No.: 13/517,399

(22) PCT Filed: Dec. 23, 2010

(86) PCT No.: PCT/KR2010/009236

§ 371 (c)(1),
(2), (4) Date: Sep. 14, 2012

(87) PCT Pub. No.: WO2011/078586

PCT Pub. Date: Jun. 30, 2011

(65) Prior Publication Data

US 2012/0324877 A1 Dec. 27, 2012

(30) Foreign Application Priority Data

Dec. 23, 2009 (KR) ..... 10-2009-0129773

(51) Int. Cl.
*F15B 13/02* (2006.01)
*E02F 3/43* (2006.01)
(Continued)

(52) U.S. Cl.
CPC ..... *E02F 3/435* (2013.01); *E02F 9/2075* (2013.01); *E02F 9/2217* (2013.01);
(Continued)

(58) Field of Classification Search
CPC ..... E02F 9/2217; F15B 11/17; F15B 21/14; F15B 2211/20576; F15B 2211/31511; F15B 2211/353; F15B 2211/6652; F15B 2211/88
USPC ..... 60/414, 421, 484
See application file for complete search history.

(56) References Cited

U.S. PATENT DOCUMENTS 5,649,422 A * 7/1997 Baginski et al. ..... 60/431
7,043,906 B2 * 5/2006 Suzuki et al. ..... 60/422
(Continued)

FOREIGN PATENT DOCUMENTS

CN 1993524 A 7/2007
JP 09-125449 A 5/1997
(Continued)

OTHER PUBLICATIONS

Office Action dated Sep. 3, 2013 issued in Japanese Patent Application No. 2012-545853, 5 pages.
(Continued)

*Primary Examiner* — Dwayne J White
*Assistant Examiner* — Matthew Wiblin
(74) *Attorney, Agent, or Firm* — John D. Veldhuis-Kroeze; Westman, Champlin & Koehler, P.A.

(57) ABSTRACT

Disclosed is a system for driving a boom of a hybrid excavator, and a method for controlling the same. The system comprises: an electric motor; a capacitor for storing electricity generated by the electric motor; a hydraulic pump motor driven by the electric motor to supply working oil to a boom; a boom control valve having a closed circuit selectively connecting/disconnecting a discharge line and an inlet line of the hydraulic pump motor to/from a head or a load of the boom; a main pump arranged separately from the motor to supply working oil; a boom-assisting valve connecting discharge lines of the main pump and the hydraulic pump motor to combine discharged working oil; and a control unit controlling the electric motor, the hydraulic pump motor, and the boom control valve. The system minimizes energy loss during excavation, ensures performance of the boom, and recovers regenerative energy from the boom.

4 Claims, 4 Drawing Sheets

(51) Int. Cl.

| | |
|---|---|
| ***E02F 9/20*** | (2006.01) |
| ***E02F 9/22*** | (2006.01) |
| ***F15B 11/17*** | (2006.01) |
| ***F15B 13/044*** | (2006.01) |

(52) U.S. Cl.

CPC ..... *E02F 9/2235* (2013.01); *E02F 9/2242* (2013.01); *E02F 9/2282* (2013.01); *E02F 9/2292* (2013.01); *E02F 9/2296* (2013.01); *F15B 11/17* (2013.01); *F15B 13/044* (2013.01); *F15B 2211/20576* (2013.01); *F15B 2211/3053* (2013.01); *F15B 2211/327* (2013.01); *F15B 2211/7128* (2013.01); *F15B 2211/7142* (2013.01)

(56) References Cited

U.S. PATENT DOCUMENTS

| | | | | |
|---|---|---|---|---|
| 2005/0246082 | A1* | 11/2005 | Miki et al. | 701/50 |
| 2008/0110166 | A1* | 5/2008 | Stephenson et al. | 60/414 |
| 2009/0077837 | A1 | 3/2009 | Tozawa et al. | |
| 2009/0165450 | A1* | 7/2009 | Cherney et al. | 60/413 |

FOREIGN PATENT DOCUMENTS

| | | |
|---|---|---|
| JP | 2001-012406 | 1/2001 |
| JP | 2004-190845 | 7/2004 |
| JP | 2006-336306 | 12/2006 |
| JP | 2006-336307 | 12/2006 |
| JP | 2006-336849 | 12/2006 |
| JP | 2007-217992 A | 8/2007 |
| KR | 20-1995-0003826 | 5/1995 |
| WO | 01-88381 | 11/2001 |

OTHER PUBLICATIONS

Search Report dated Sep. 29, 2011 written in Korean with English translation attached for international application PCT/KR2010/009236, filed Dec. 23, 2010, 5 pages.

* cited by examiner

SYSTEM FOR DRIVING A BOOM OF A HYBRID EXCAVATOR AND A CONTROL METHOD THEREOF

This Application is a Section 371 National Stage Application of International Application No. PCT/KR2010/009236, filed Dec. 23, 2010 and published, not in English, as WO2011/078586 on Jun. 30, 2011.

BACKGROUND

The present disclosure is contrived to solve the problems in the related art and an object of the present disclosure is to provide a system for driving a boom of a hybrid excavator that minimize energy loss, ensures operability of a boom, and restores recoverable energy of the boom while excavating that is the main use of the excavator, even with a use of an electric motor, and a method of controlling the system.

The discussion above is merely provided for general background information and is not intended to be used as an aid in determining the scope of the claimed subject matter.

SUMMARY

A system for driving a boom in a hybrid excavator according to the present disclosure includes: an electric motor that operates as a motor or an electricity generator; a capacitor that stores electricity generated by the electric motor; a hydraulic pump motor that is driven by the electric motor and supplies working fluid to a boom; a boom control valve that constitutes a closed circuit selectively connecting/disconnecting a discharge line and an intake line of the hydraulic pump motor to/from a head or a rod of the boom; a main pump that is driven by a driving source disposed separately from the electric motor and supplies the working fluid to a bucket, a traveling motor, or an arm; a boom-assistant valve that allows the working fluid discharged from the main pump and the hydraulic pump motor to meet each other by connecting the discharge line of the main pump to the discharge line of the hydraulic pump motor; and a control unit that controls the electric motor, the hydraulic pump motor, and the boom control valve.

The first control valve is selectively switched when the boom is lifted, and is disconnected when the boom is descended, and the second control valve is disconnected when the boom is lifted, and is selectively switched when the boom is descended.

Further, the first control valve may be connected and allow the flow rate flowing into the hydraulic pump motor from the boom cylinder to flow into the tank, when the flow rate flowing into the hydraulic pump motor from the boom cylinder exceeds the available capacity of the hydraulic pump motor or the capacity of the electric motor when the boom is descended.

A method of controlling a system for driving a boom of a hybrid excavator according to the present disclosure includes: detecting the amount of operation of a boom joystick; determining lifting or descending of a boom due to operation of the boom joystick; opening a first control valve when the boom is lifted; comparing the driving power of the boom according to the amount of operation of the boom joystick with the maximum suppliable power of an electric motor when the boom is lifted and comparing the consumed flow rate of a boom cylinder with the maximum flow rate of a hydraulic pump motor when the driving power of the boom is smaller than the maximum suppliable power of the electric motor; disconnecting the boom-assistant valve, when the consumed flow rate of the boom cylinder is smaller than the maximum flow rate of the hydraulic pump motor; connecting the boom-assistant valve, when the driving power of the boom is larger than the maximum suppliable power of the electric motor; opening the second control valve when the boom is descended, comparing the recovery flow rate of the boom cylinder with the available flow rate of the hydraulic pump motor, when the recovery power of the boom is larger the maximum recoverable power of the electric motor by comparing the recovery power of the boom with the maximum recoverable power of the electric motor; disconnecting the first control valve, when the recovery flow rate of the boom cylinder is smaller than the available flow rate of the hydraulic pump motor; connecting the first control valve, when the recovery flow rate of the boom cylinder is larger than the available flow rate of the hydraulic pump motor; and connecting the first control valve, when the recovery power of the boom is larger than the maximum recoverable power of the electric motor.

According to the system for driving a boom in a hybrid excavator and a control method thereof of the present disclosure, it is possible to minimize energy loss, ensure operational performance of a boom and recover recoverable energy of the boom, while excavating that is the main use of the excavator, even with a use of an electric motor.

That is, it is possible to improve fuel efficiency by removing a loss generated in a hydraulic system in a low-flow rate fine operation by driving the boom, using the electric motor and the boom hydraulic pump motor when the boom is lifted.

Further, the flow rate required for the initial fine operation section when the boom operates alone is supplied from the electric motor and the boom hydraulic pump motor, and the part exceeding the part corresponding to the maximum suppliable flow rate of the boom and power can be supplied by using the existing hydraulic system with the main pump.

Further, it is possible to ensure operation performance of the boom equivalent to the existing excavator while using small-capacity electric motor and pump motor, and recover the energy of the boom, and when high power and a large flow rate are suddenly required, it is possible to ensure the performance equivalent to the existing excavator by assisting power and flow rate by using the existing hydraulic system.

Further, when there is suddenly large recovery energy, the part exceeding the capacity is bypassed, and it is possible to supply most energy required to drive the boom from only the capacities of the hydraulic pump and the electric motor of about the maximum suppliable flow rate of the boom and the maximum power of the engine, and it is possible to recover most of the recoverable energy of the boom.

Further, it is possible to remove a loss in the existing hydraulic system and simplify the structure of the main control valve, by separating the boom from the existing hydraulic system.

Further, it is possible to improve operational performance of the arm and the bucket by making two main pumps in charge of the arm and the bucket.

This summary and the abstract are provided to introduce a selection of concepts in a simplified form that are further described below in the Detailed Description. The summary and the abstract are not intended to identify key features or essential features of the claimed subject matter, nor are they intended to be used as an aid in determining the scope of the claimed subject matter.

Figure 1:
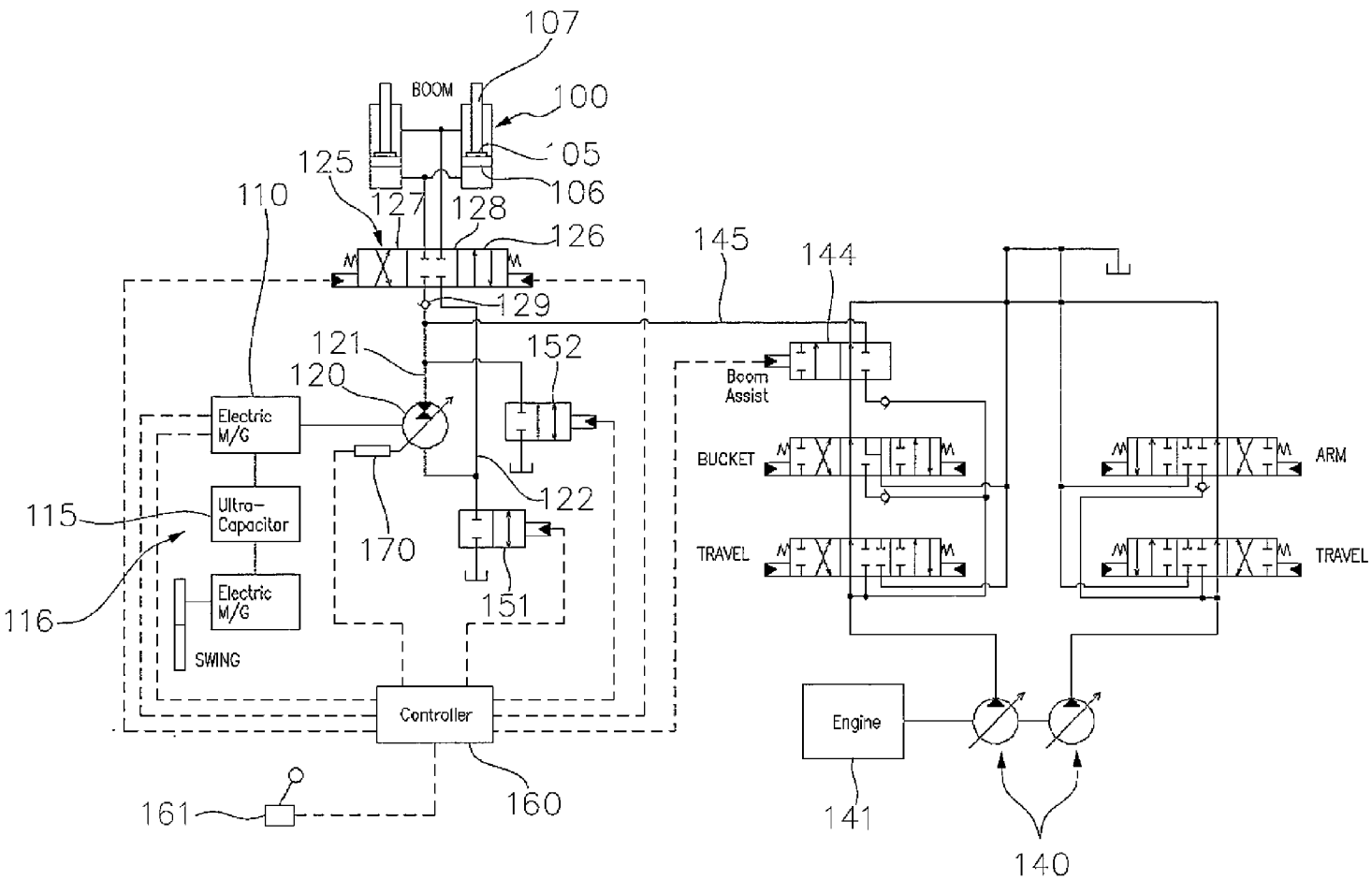
FIG. 1 is a configuration diagram of a system for driving a boom of a hybrid excavator according to an exemplary embodiment of the present disclosure.

| | |
|---|---|
| 100: Boom | 105: Boom cylinder |
| 106: Head | 107: Rod |
| 110: Electric motor | 115: Capacitor |
| 116: Electricity storage | |
| 120: Hydraulic pump motor | |
| 121: Discharge line | 122: Intake line |
| 125: Boom control valve | |
| 126: Normal-directional connecting portion | |
| 127: Cross-connecting portion | |
| 128: Disconnecting portion | |
| 129: Check valve | 140: Main pump |
| 141: Engine | 144: Boom-assistant valve |
| 145: Boom-assistant line | |
| 151: First control valve | |
| 152: Second control valve | |
| 160: Control unit | |
| 170: Tilting angle control device | |

DETAILED DESCRIPTION

Hereinafter, preferable embodiments of a system for driving a boom of a hybrid excavator according to the present disclosure and a method of controlling the system will be described with reference to the accompanying drawings. The thicknesses of lines or sizes of components illustrated in the drawings may be exaggerated for the clarity and convenience of the following description. Further, the terminologies described below are terminologies determined in consideration of the functions in the present disclosure and may be construed in different ways by the intention of users and operators or a custom.

Figure 2:
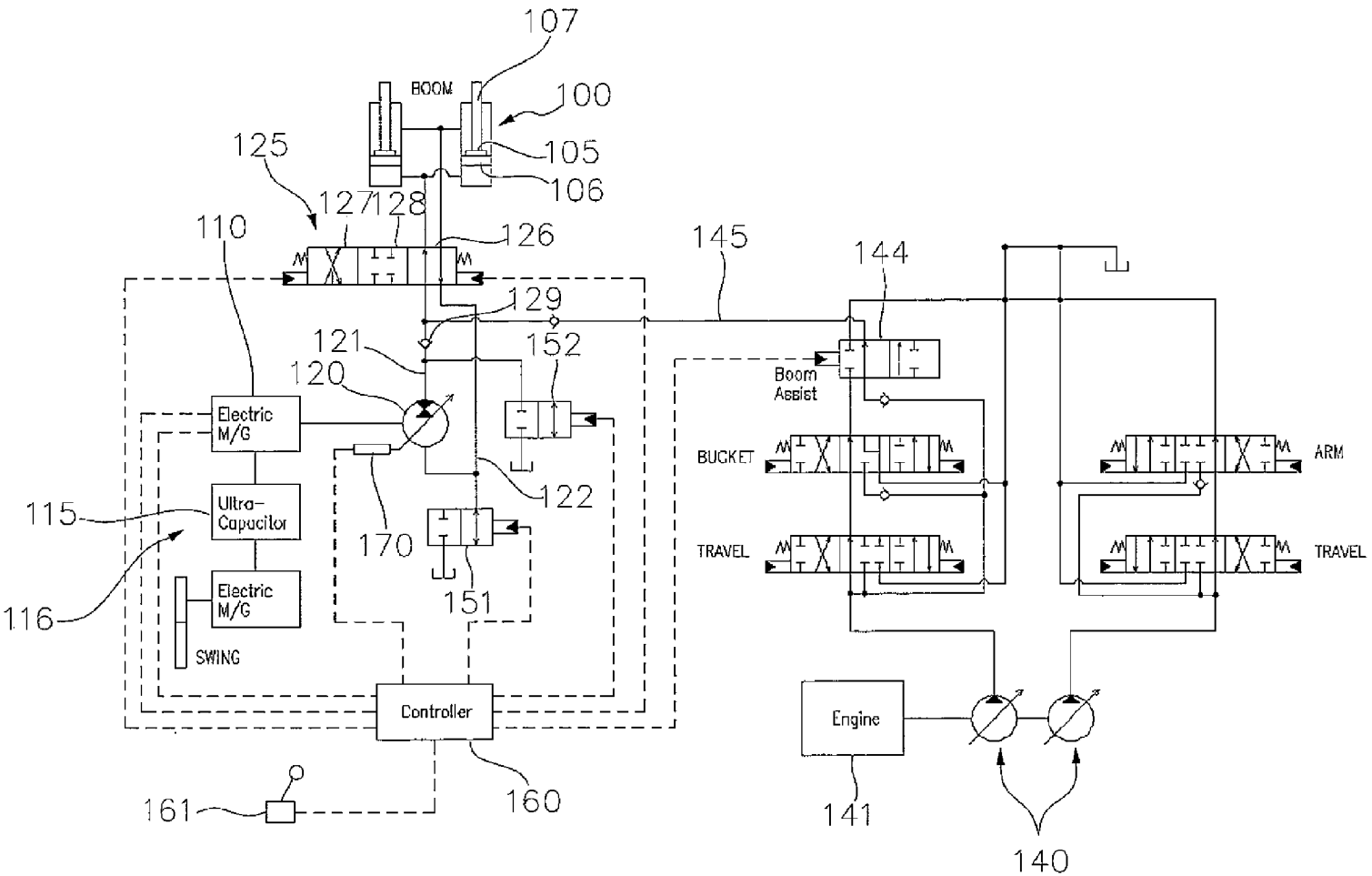
FIG. 2 is a configuration diagram showing a lifting state of the boom of FIG. 1.
Figure 3:
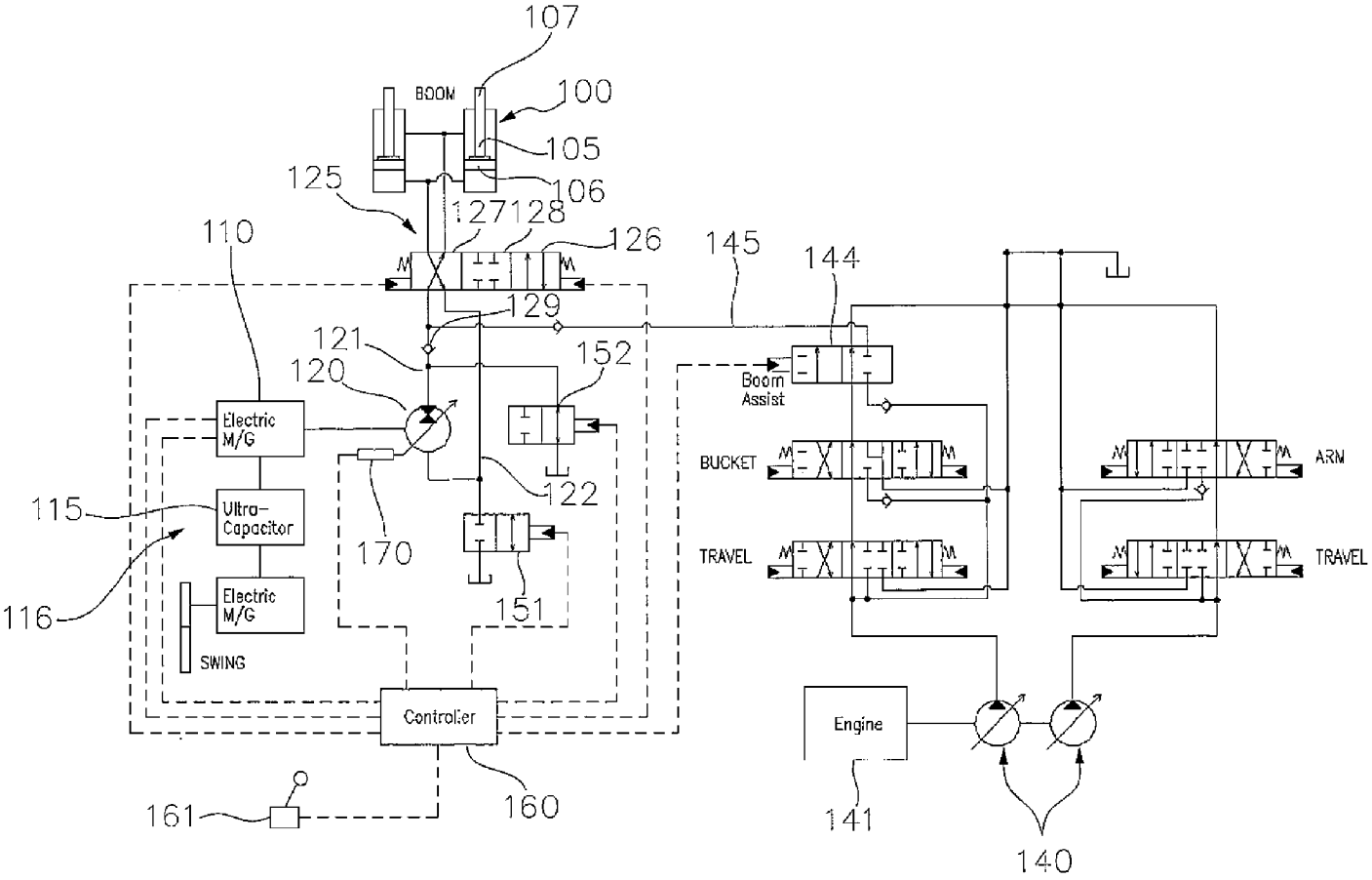
FIG. 3 is a configuration diagram showing a descending state of the boom of FIG. 1.
Figure 4:
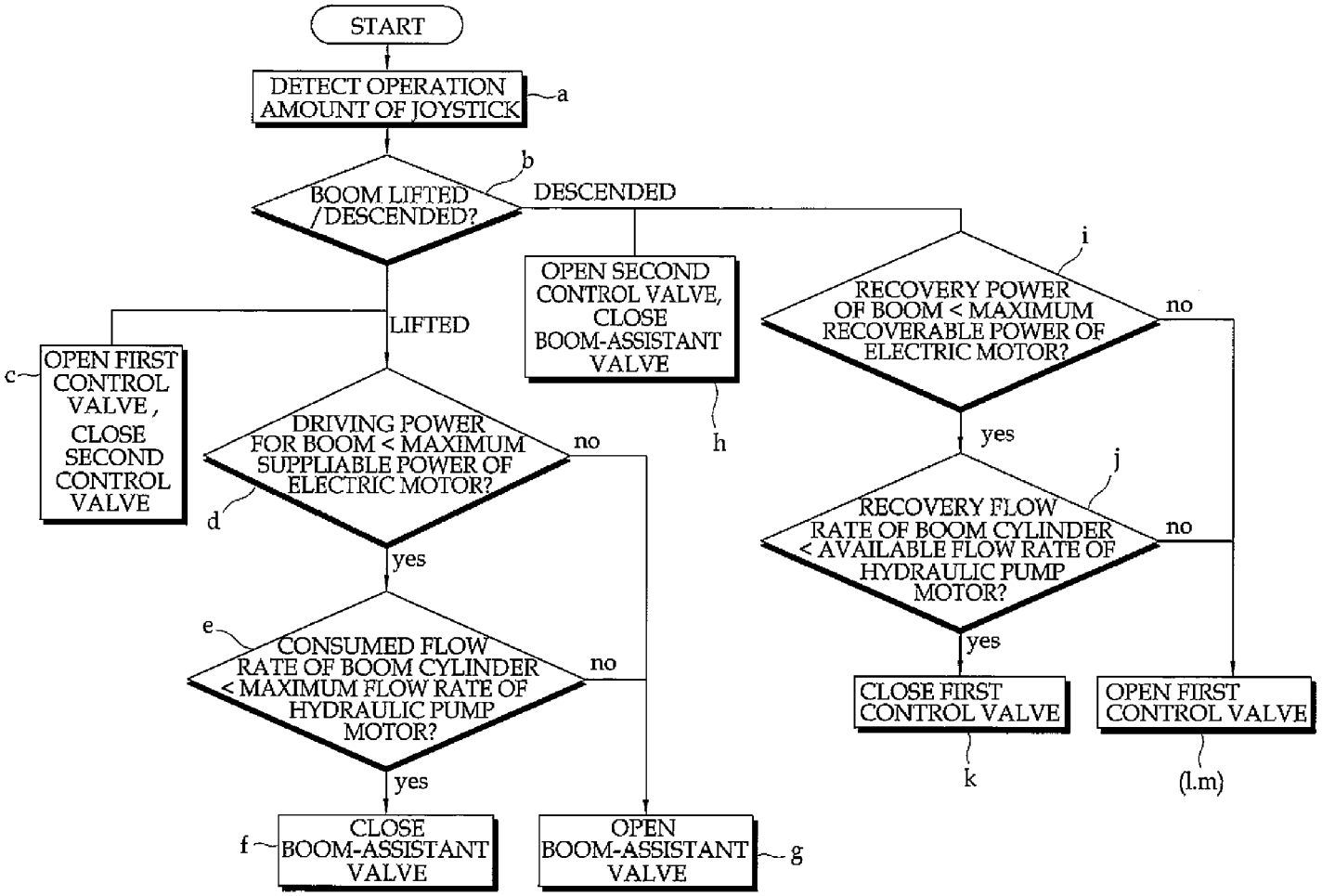
FIG. 4 is a flowchart of a method of controlling a system for driving a boom of a hybrid excavator according to an exemplary embodiment of the present disclosure.

FIG. 1 is a configuration diagram of a system for driving a boom of a hybrid excavator according to an exemplary embodiment of the present disclosure, FIG. 2 is a configuration diagram showing a lifting state of the boom of FIG. 1, FIG. 3 is a configuration diagram showing a descending state of the boom of FIG. 1, and FIG. 4 is a flowchart of a method of controlling a system for driving a boom of a hybrid excavator according to an exemplary embodiment of the present disclosure.

Referring to FIG. 1, a system for driving a boom of a hybrid excavator according to an exemplary embodiment of the present disclosure includes an electric motor 110 that is operated as a motor or an electricity generator, a capacitor 115 that stores electricity generated by the electric motor 110, a hydraulic pump motor 120 that is driven by the electric motor 110 and supplies working fluid to a boom 110, and a boom control valve 125 that selectively connects/disconnects a discharge line 121 and an intake line 122 of the hydraulic pump motor 120 to/from a head 106 or a rod 107 of the boom 100. The capacitor of the present exemplary embodiment can be supplied with most power by the operation of a motor/electricity generator (not shown) connected to an engine.

The boom control valve 125 is connected to a main pump 140 by a boom-assistant line 145 through which working fluid is supplied. Two main pumps 140 are provided and supply the working fluid to a bucket, a traveling motor, or an arm by being driven by an engine 141.

The hydraulic pump motor 120 is connected with the discharge line 121 through which the working fluid is discharged and the intake line 122 through which the working fluid flows inside. The discharge line 121 and the intake line 122 are connected to the head 106 or the rod 107 of a boom cylinder 105 by the boom control valve 125. That is, the hydraulic circuit contact point of the discharge line 121 and the intake line 122 is connected or disconnected by the boom control valve 125.

The boom control valve 125 has a normal-directional connecting portion 126 for lifting the boom 100 by connecting the discharge line 121 with the intake line 122 in a normal direction, a cross-connecting portion 127 that connects the discharge line 121 with the intake line 122 in the opposite direction, and a disconnecting portion 128 that cuts the connection between the discharge line 121 and the intake line 122. The boom control valve 125 is operated by an electronic proportional control valve or a separate pilot hydraulic line and changes the connection state between the discharge line 121 and the intake line 122.

A check valve 129 is disposed in the discharge line 121 of the hydraulic pump motor 120 to prevent a backward flow and the boom-assistant line 145 is connected close to the check valve 129 from the hydraulic pump motor 120. A first control valve 151 for connection with a tank is connected between the hydraulic pump motor 120 and the discharge line 121 of the boom control line 125. A second control valve 152 for connection with the tank is connected between the connection portion of the boom-assistant line 145 and the hydraulic pump motor 120. The operations of the electric motor 110, the hydraulic pump motor 120, the boom control valve 125, the first control valve 151, and the second control valve 152 are controlled by a control unit 160.

Referring to FIG. 2, when a signal for lifting the boom 100 is input to the control unit 160 from a boom joystick 161, the electric motor 110 is operated as a motor by the control unit 160 and drives the hydraulic pump motor 120 as a pump. Further, the outlet of the hydraulic pump motor 120 is connected to the head 106 of the boom 100 through the discharge line 121 and the rod 107 of the boom 100 is connected to the inlet of the hydraulic pump motor 120 through the intake line 122 of the hydraulic pump motor 120, by switching the boom control valve 125. In this process, the boom 100 starts to be lifted by the flow rate discharged from the hydraulic pump motor 120 and the speed of the boom 100 is controlled by control of the revolution speed of the electric motor 110 and tilting angle control performed by a tilting angle control device 170.

A closed circuit is implemented between the hydraulic pump motor 120 and the boom cylinder 105 and the flow rate supplied to the hydraulic pump motor 120 from the boom cylinder 105 is smaller than the flow rate supplied to the boom cylinder 105 from the hydraulic pump motor 120 by a cylinder area difference. The deficit of the flow rate is supplied from the tank by connecting the first control valve 151.

Further, the control unit 160 calculates the power of the electric motor 110 from the torque and rotation speed of the electric motor 110 and monitors the flow rate of the hydraulic pump motor 120 from the tilting angle and the rotation speed outputted from the tilting angle control device 170.

Meanwhile, when the control signal of the boom joystick 161 increases over the flow rate supplied from the hydraulic pump motor 120 or the capacity of the electric motor 110, the control unit 160 supplies the flow rate of the main pump 140 to the boom cylinder 105 by controlling the boom-assistant valve 144. The control unit 160 controls opening/closing of the boom-assistant valve 144 such that the boom cylinder 105 can follow the signal of the boom joystick 161. The boom-assistant valve 144 is switched to the right by the control unit 160 when being disconnected, and the boom-assistant line 145 is connected to the main pump 140 driven by the engine 141.

Referring to FIG. 3, when a signal for descending the boom 100 is inputted to the control unit 160 from the boom joystick 161, the hydraulic pump motor 120 is operated by the flow rate returning from the boom cylinder 105 by the control unit 160, the electric motor 110 is operated as an electricity generator by the driving force of the hydraulic pump motor 120, and the generated power is stored in an electricity storage 116 equipped with the capacitor 115.

As the boom 100 is descended, the boom control valve 125 is switched and the head 106 of the boom 100 is connected to the inlet of the hydraulic pump motor 120 by the intake line 122, and the rod 107 of the boom 100 is connected to the outlet of the hydraulic pump motor 120 by the discharge line 121. The descending speed of the boom 100 is controlled by controlling the rotation speed of the hydraulic pump motor 120 by controlling the tilting angle through the tilting angle control device 170, and the amount of electricity generated by the electric motor 110 is also controlled.

Further, a closed circuit is implemented between the hydraulic pump motor 120 and the cylinder and the flow rate supplied to the hydraulic pump motor 120 from the boom cylinder 105 is larger than the flow rate supplied to the boom cylinder 105 from the hydraulic pump motor 120 by an area difference of the boom cylinder 105 due to whether there is the rod 107. The excessive flow rate supplied from the hydraulic pump motor 120 to the boom cylinder 105 is discharged to the tank, as the second control valve 152 connected to the discharge line 121 is connected by a signal of the control unit 160.

Further, when a flow rate over the available flow rate of the hydraulic pump motor 120 or the capacity of the electric motor 110 is discharged from the boom cylinder 105 and supplied to the hydraulic pump motor 120, the control unit 160 can discharge an excessive flow rate over the capacities of the hydraulic pump motor 120 and the electric motor 110 to the tank by connecting the first control valve 151. The first control valve 151 discharges the excessive flow rate of the working fluid flowing to the hydraulic pump motor 120 through the intake line 122 from the boom cylinder 105 to the tank.

Referring to FIGS. 2 and 3, the first control valve 151 can supply insufficient working fluid to the boom cylinder 105 by connecting the tank when the boom 100 is lifted, and on the contrary, it is disconnected except for when an excessive flow rate is generated to the hydraulic pump motor 120 from the boom cylinder 105, when the boom 100 is descended.

Further, the second control valve 152 that has been disconnected when the boom 100 is lifted discharges the flow rate excessively supplied to the boom cylinder 105 from the hydraulic pump motor 120 to the tank by being connected when the boom 100 is descended, The second control valve 152 can be controlled when being open as the boom is descended, as described above, but it may be additionally controlled, as described below.

That is, the second control valve 152 may be controlled to be opened only when the flow rate supplied through the hydraulic pump motor 120 is larger than the flow rate necessary for the boom head 106, while keeping closed when the boom 100 is descended.

Further, when the hydraulic pump motor 120 supplies an unnecessarily excessive flow rate due to various problems, the flow rate circulating is drained to prevent a safety accident and damage to the system, in which it is more preferable that the first control valve 151 operates with the second control valve 152 to be opened such that the working fluid is drained.

Further, the boom-assistant valve 144 is connected by the control unit 160 such that the flow rate of the main pump 140 is supplied to the boom cylinder 105, when the control signal of the boom joystick 161 increases over the flow rate supplied from the hydraulic pump motor 120 or the capacity of the electric motor 110.

Referring to FIGS. 2 to 4, a method of controlling a system for driving a boom of a hybrid excavator according to an exemplary embodiment of the present disclosure includes (a) detecting the amount of operation of the boom joystick 161, (b) determining lifting or descending of the boom 100 due to the operation of the boom joystick 161, (c) opening the first control valve 151 when the boom 100 is lifted, (d) comparing the driving power of the boom 100 according to the amount of operation of the boom joystick 161 with the maximum suppliable power of the electric motor 110 when the boom 100 is lifted, and (e) comparing the consumed flow rate of the boom cylinder 105 with the maximum flow rate of the hydraulic pump motor 120 when the driving power of the boom 100 is smaller than the maximum suppliable power of the electric motor 110.

When the consumed flow rate of the boom cylinder 105 is smaller than the maximum flow rate of the hydraulic pump motor 120, (f) disconnecting the boom-assistant valve 144 is performed. Further, when the driving power of the boom 100 is larger than the maximum suppliable power of the electric motor 110, (g) supplying insufficient working fluid by connecting the main pump 140 by opening to the boom-assistant valve 144 is included.

Meanwhile, when the boom 100 is descended, (h) opening the second control valve 152 and (i) comparing the recovery power of the boom 100 with the maximum recoverable power of the electric motor 110 is included. Further, when the recovery power of the boom 100 is smaller the maximum recoverable power of the electric motor 110, (j) comparing the recovery flow rate of the boom cylinder 105 with the available flow rate of the hydraulic pump motor 120 is included. When the recovery flow rate of the boom cylinder 105 is smaller than the available flow rate of the hydraulic pump motor 120, (k) disconnecting the first control valve 151 is included. On the contrary, when the recovery flow rate of the boom cylinder 105 is larger than the available flow rate of the hydraulic pump motor 120, (l) discharging the excessive flow rate to the tank by connecting the first control valve 151 is included. Further, when the recovery power of the boom 100 is larger than the maximum recoverable power of the electric motor 110, (m) discharging the excessive flow rate to the tank by connecting the first control valve 151 is included.

As described above, the system for driving a boom of a hybrid excavator according to an exemplary embodiment of the present disclosure and a method of controlling the system can improve fuel efficiency by removing a loss generated in a hydraulic system in a low-flow rate fine operation by driving the boom 100 by using the electric motor 110 and the hydraulic pump motor 120 when the boom 100 is lifted.

Further, the flow rate required for the initial fine operation section when the boom 100 operates alone is supplied from the electric motor 110 and the hydraulic pump motor 120, and the part exceeding the part corresponding to the maximum suppliable flow rate of the boom 100 can be supplied by using the existing hydraulic system with the main pump 140.

Further, it is possible to ensure operation performance of the boom 100 equivalent to the existing excavator even while using the small-capacity electric motor 110 and pump motor, and recover the energy of the boom 100. Further, the hybrid driving system using the electric motor 110 and the hydraulic pump motor 120 can perform most energy supply and energy recovery in excavating.

Further, when high power and large flow rate are suddenly required, it is possible to ensure the performance equivalent to the existing excavator by assisting power and flow rate by using the existing hydraulic system. Further, when there is a suddenly large recovery energy, the part exceeding the capacity is bypassed, and it is possible to supply most energy required to drive the boom 100 from only the capacities of the hydraulic pump and the electric motor 110 of about the maximum suppliable flow rate of the boom 100 and the maximum power of the engine 141, and it is possible to recover most of the recoverable energy of the boom 100.

The present disclosure may be applied to a system for driving a hybrid excavator in construction equipment.

Although the present disclosure has been described with reference to exemplary and preferred embodiments, workers skilled in the art will recognize that changes may be made in form and detail without departing from the spirit and scope of the disclosure.

The invention claimed is:

1. A system for driving a boom of a hybrid excavator, comprising:

an electric motor that operates as a motor or an electricity generator;

a capacitor that stores electricity generated by the electric motor;

a hydraulic pump motor that is driven by the electric motor and supplies working fluid to a boom cylinder;

a boom control valve that constitutes a closed circuit selectively connecting/disconnecting a discharge line of the hydraulic pump motor, which connects a discharge side of the hydraulic pump motor with the boom control valve, and an intake line of the hydraulic pump motor, which connects an intake side of the hydraulic pump motor with the boom control valve, to/from a head or a rod of the boom cylinder;

a main pump that is driven by a driving source disposed separately from the electric motor and supplies the working fluid to a bucket, a traveling motor, or an arm;

a boom-assistant valve that allows the working fluid discharged from the main pump and the hydraulic pump motor to meet each other by connecting the discharge line of the main pump to the discharge line of the hydraulic pump motor;

a first control valve that connects the intake line with a tank for the working fluid;

a second control valve that connects the discharge line to tank for the working fluid;

wherein when the boom is descended a flow rate of working fluid from the boom cylinder flows through the boom control valve and the intake line to the intake side of the hydraulic pump motor and from the hydraulic pump motor through the discharge line and the second control valve to tank, and wherein when the boom is descended and when the flow rate flowing into the hydraulic pump motor from the boom cylinder exceeds available capacity of the hydraulic pump motor or a capacity of the electric motor, the first control valve is connected to tank and drains at least a portion of the flow rate flowing into the hydraulic pump motor from the boom cylinder to tank; and a control unit that controls the electric motor, the hydraulic pump motor, the boom control valve, the first control valve and the second control valve.

2. The system of claim 1, wherein when the boom is lifted the first control valve is connected and the second control valve is disconnected.

3. The system of claim 1, wherein the boom-assistant valve is switched such that a flow rate of the main pump is supplied to the boom cylinder, when a control signal of a boom joystick increases and a flow rate over a flow rate supplied from the hydraulic pump motor or a capacity of the electric motor is necessary.

4. A method of controlling a system for driving a boom of a hybrid excavator, the method comprising:

(a) detecting an amount of operation of a boom joystick;

(b) determining lifting or descending of a boom due to operation of the boom joystick;

(c) opening a first control valve connected to a tank when the boom is lifted to return a flow rate of working fluid from a boom cylinder to tank;

(d) comparing a driving power of the boom according to the amount of operation of the boom joystick with a maximum supply power of an electric motor when the boom is lifted;

(e) comparing a consumed flow rate of the boom cylinder with a maximum flow rate of a hydraulic pump motor when the driving power of the boom is smaller than the maximum supply power of the electric motor;

(f) disconnecting a boom-assistant valve, when the consumed flow rate of the boom cylinder is smaller than the maximum flow rate of the hydraulic pump motor;

(g) connecting the boom-assistant valve when the driving power of the boom is larger than the maximum supply power of the electric motor;

(h) connecting the boom-assistant valve when the consumed flow rate of the boom cylinder is larger than the maximum flow rate of the hydraulic pump motor;

(i) opening a second control valve connected to tank when the boom is descended to return the flow rate of working fluid from the boom cylinder to tank through the hydraulic pump motor to drive the electric motor and through the second control valve;

(j) comparing a recovery power of the boom with a maximum recoverable power of the electric motor;

(k) comparing a recovery flow rate of the boom cylinder with an available flow rate of the hydraulic pump motor, when the recovery power of the boom is smaller than the maximum recoverable power of the electric motor;

(l) disconnecting the first control valve while the boom is descending, when the recovery flow rate of the boom cylinder is smaller than the available flow rate of the hydraulic pump motor to return the flow rate of working fluid from the boom cylinder to tank through the hydraulic pump motor, to drive the electric motor, and through the second control valve;

(m) connecting the first control valve while the boom is descending, when the recovery flow rate of the boom cylinder is larger than the available flow rate of the hydraulic pump motor to return at least a portion of the flow rate of working fluid from the boom cylinder to tank through the first control valve; and (n) connecting the first control valve while the boom is descending, when the recovery power of the boom is larger than the maximum recoverable power of the electric motor to return at least a portion of the flow rate of working fluid from the boom cylinder to tank through the first control valve.

* * * * *